United States Patent [19]

Ziehn

[11] Patent Number: 4,461,310

[45] Date of Patent: Jul. 24, 1984

[54] PROCESS FOR IMPROVING THE FILLING CAPACITY OF TOBACCOS

[75] Inventor: Klaus-Dieter Ziehn, Pinneberg, Fed. Rep. of Germany

[73] Assignee: H.F. & Ph.F. Reemtsma GmbH & Co., Hamburg, Fed. Rep. of Germany

[21] Appl. No.: 378,390

[22] Filed: May 14, 1982

[30] Foreign Application Priority Data

May 15, 1981 [DE] Fed. Rep. of Germany ..... 3119330

[51] Int. Cl.[3] ..... A24B 3/18

[52] U.S. Cl. ..... 131/296

[58] Field of Search ..... 131/290, 291, 300, 296

[56] References Cited

U.S. PATENT DOCUMENTS 4,289,148 9/1981 Ziehn ..... 131/291

FOREIGN PATENT DOCUMENTS 2912822 4/1979 Fed. Rep. of Germany .

*Primary Examiner*—Vincent Millin

*Attorney, Agent, or Firm*—Cushman, Darby & Cushman

[57] ABSTRACT

The invention relates to a process for improving the filling capacity of tobaccos by treating the tobacco with a gas under pressure and subsequent heating after relief of the pressure, in which the tobacco is treated with nitrogen and/or argon at working pressures up to 1000 bar and at an operating temperature in the range 0° to 50° C. followed, after pressure relief, by brief thermal aftertreatment, in which the tobacco to be treated with nitrogen and/or argon has a moisture content of up to approximately 15% and the thermal aftertreatment is performed with steam having a moisture content of 0.5 to 10 Kg/m$^3$ or with saturated steam.

9 Claims, No Drawings

PROCESS FOR IMPROVING THE FILLING CAPACITY OF TOBACCOS

BACKGROUND OF THE INVENTION

The invention relates to a process for improving the filling capacity of tobaccos by treating the tobacco with a gas under pressure and subsequent heating after pressure relief, in which the tobacco is treated with nitrogen and/or argon at working pressures up to 1000 bar and at an operating temperature in the range of 0° to 50° C. followed, after pressure relief, by brief thermal aftertreatment.

Such a process is known e.g. from DE-OS No. 29 03 300 and related Ziehn U.S. Pat. No. 4,289,148, in which the tobacco firstly undergoes high pressure gas treatment and then thermal aftertreatment. The high pressure gas treatment leads to the tobacco absorbing gas, the tobacco absorbing a sufficiently large quantity of gas as a result of the high final pressure, the short pressure reduction times and a possible moistening of the tobacco prior to treatment. During the subsequent thermal after-treatment, the occluded gas expands as a result of the external heat supply and produces an outwardly directed pressure and consequently a swelling of the tobacco structure. The entire disclosure of the Ziehn U.S. Pat. No. 4,289,148 is hereby incorporated by reference and relied upon.

The experts have hitherto been of the opinion that the improvement to the filling capacity increases with the proportion of gas absorbed and it was also assumed that the tobacco used should have some initial moisture content.

It has been considered a disadvantage of the known process that a tobacco being thus treated frequently formed cohesive intermingled strands of tobacco following high pressure gas treatment, resulting in possible difficulties during the thermal aftertreatment.

The problem of the present invention is to improve the process of DE-OS No. 29 03 300 and the Ziehn U.S. patent in such a way as to further increase the filling capacity of tobacco in a simpler and more energy-saving manner.

SUMMARY OF THE INVENTION

It has surprisingly been found that very good swelling effects, and especially at lower pressure can be obtained if the tobacco undergoes the high pressure gas treatment without separate, prior moistening and specifically with its normal moisture content of 10 to 15%. This is followed, after pressure relief, by a thermal aftertreatment with steam having a water content of 0.5 to 10 kg/m$^3$ and preferably with saturated steam.

This problem is solved by a process comprising treating the tobacco with a gas under pressure and subsequent heating accompanied by expansion, in which the tobacco is treated with nitrogen, argon or a mixture of nitrogen and argon at working pressures up to 1000 bar and at an operating temperature in the range 0° to 50° C. following, after pressure relief, by brief thermal aftertreatment, and wherein the tobacco to be treated with nitrogen, argon, or mixture of nitrogen and argon has a moisture content of up to approximately 15% and the thermal aftertreatment is performed with steam having a moisture content of 0.5 to 10 kg/m$^3$ or with saturated steam. Preferably, the high pressure gas treatment is performed with nitrogen at a minimum pressure of 150 bar or with argon at a minimum pressure of 50 bar.

Without wishing to stipulate a particular mechanism, it can be assumed that, compared with the known process, the increased cooling observed when blowing off the process gas in the case of a tobacco with a lower moisture content may lead to the occlusion of a large quantity of gas. Compared with the aftertreatment methods of the known process, the supply of steam releases much larger quantities of energy by condensation, so that the volume is increased particularly suddenly, accompanied by the simultaneous thorough moistening and resulting increase in the cell wall elasticity. This leads to a further advantage of the process of the invention that the high pressure gas treatment can be performed at lower pressures and leads to higher gains in filling capacity gains. Thus pressures of e.g. 50 to 1000 bar can be employed such as 50 to 150 bar. The steam can have a temperature from 100° C. to 200° C. or even higher.

It has surprisingly also been found that, at will, the tobacco can be supplied either before the high pressure gas treatment or after the thermal aftertreatment with suitable flavouring agents, without the improved filling capacity being impaired.

An important advantage of the process of the invention in connection with its technical performance is that a tobacco used having its normal moisture content, after pressure relief following the high pressure gas treatment, can be further processed without any other process stages; in addition, the possible additional process stage of moistening is eliminated.

As in the Ziehn U.S. patent, the heating can be for 0.1 to 10 minutes, usually 0.5 to 3 minutes.

The process can comprise, consist essentially of, or consist of the steps set forth with the materials disclosed.

The following examples serve to illustrate the invention.

EXAMPLE 1

Virginia tobacco was treated with nitrogen on conventional equipment of the type described in the Ziehn U.S. patent and DE-OS No. 29 03 300, the weighed in tobacco quantity being 200 g in each case. Treatment took place at the pressures and tobacco moisture contents given in the following Table I, accompanied by pressure reduction times of approximately 1.3 to 2 minutes. The thus treated tobacco then immediately underwent thermal aftertreatment lasting about 1 minute. On the one hand the tobacco was treated with saturated steam at 100° C. in accordance with the invention and on the other hand, for comparison purposes, it was treated in the conventional manner by microwave heating or in the drying oven.

During the steam aftertreatment of the impregnated tobacco, the tobacco obtained from the high pressure gas treatment was spread out into a flat layer immediately following decompression and said layer was passed under a steam nozzle at a constant speed. The steam-treated samples were then dried to the desired moisture contents by means of hot air.

The samples were then kept under the standard conditions of 21° C. and a relative humidity of 60% for approximately 36 hours. After adjusting the equilibrium moisture content, the filling capacity of the samples was determined with a Borgwaldt densimeter.

TABLE I

| After treatment method | Final pressure (bar) | Tobacco moisture content | Filling Capacity improvement |
|---|---|---|---|
| Microwave | 300 | 12.1% | 20% |
| | | 22.3% | 45% |
| | 800 | 12.2% | 35% |
| | | 22.2% | 70% |
| Steam | 300 | 12.0% | 57% |
| | 800 | 12.5% | 92% |

EXAMPLE 2

A flue-cured and an air-cured tobacco sample in each case was treated in the manner described in Example 1. Prior to charging the autoclave, the moisture content of the tobacco was 12% and the final pressure was varied. The nitrogen-impregnated tobacco was heated with saturated steam at 100° C. following decompression. Tables II*a* and II*b* give the conditions for the individual tests and the filling capacity improvements obtained.

TABLE IIa (flue-cured tobacco samples)

| Test No. | Pressure (bar) | Tobacco moisture content | Thermal after treatment | Process gas | Filling Capacity improvement (compared with control) |
|---|---|---|---|---|---|
| 1 | 150 | 12.6% | saturated steam | $N_2$ | 35% |
| 2 | 300 | 11.7% | saturated steam | $N_2$ | 64% |
| 3 | 800 | 12.9% | saturated steam | $N_2$ | 102% |

TABLE IIb (air-cured tobacco sample)

| Test No. | Pressure (bar) | Tobacco moisture content | Thermal after treatment | Process gas | Filling Capacity improvement (compared with control) |
|---|---|---|---|---|---|
| 1 | 150 | 12.0% | saturated steam | $N_2$ | 40% |
| 2 | 300 | 12.1% | saturated steam | $N_2$ | 62% |
| 3 | 800 | 11.6% | saturated steam | $N_2$ | 85% |

EXAMPLE 3

Working took place in the same way as in Example 2, but using argon as the process gas in place of nitrogen. The results are given in Tables III*a* and III*b*.

TABLE IIIa (flue-cured tobacco)

| Test No. | Pressure (bar) | Tobacco moisture content | Thermal after treatment | Process gas | Filling Capacity improvement (compared with control) |
|---|---|---|---|---|---|
| 1 | 50 | 12.8% | saturated steam | Argon | 38% |
| 2 | 150 | 13.1% | saturated steam | Argon | 59% |
| 3 | 300 | 12.1% | saturated steam | Argon | 80% |

TABLE IIIb (air-cured tobacco)

| Test No. | Pressure (bar) | Tobacco moisture content | Thermal after treatment | Process gas | Filling Capacity improvement (compared with control) |
|---|---|---|---|---|---|
| 1 | 50 | 11.9% | saturated steam | Argon | 31% |
| 2 | 150 | 12.2% | saturated steam | Argon | 59% |
| 3 | 300 | 12.8% | saturated steam | Argon | 79% |

What is claimed is:

1. A process for improving the filling capacity of tobaccos by treating the tobacco with a gas under pressure and subsequent heating after relief of the pressure, said process comprising treating the tobacco with nitrogen, argon or a mixture of nitrogen and argon at working pressures of 50 to 1000 bar and at an operating temperature in the range of 0° to 50° C. followed, after pressure relief, by a brief thermal aftertreatment, said tobacco to be treated with nitrogen, argon, or a mixture of nitrogen and argon having a moisture content of up to approximately 15% and the thermal aftertreatment being performed with steam having a moisture content of 0.5 to 10 $Kg/m^3$ or with saturated steam, said steam releasing large quantities of energy by condensation so that the volume is increased suddenly and is accompanied by simultaneous thorough moistening of the tobacco and there is a resulting increase in the cell wall elasticity.

2. The process according to claim 1, wherein that the high pressure gas treatment is performed with nitrogen at a minimum pressure of 150 bar or with argon at a minimum pressure of 50 bar.

3. The process according to claim 1, wherein the tobacco treated has a moisture content of 10 to 15%.

4. The process according to claim 3, wherein there is employed saturated steam.

5. The process according to claim 4, wherein the saturated steam is at about 100° C.

6. The process according to claim 4, wherein the pressure is 50 to 150 bar.

7. The process according to claim 4, wherein there is employed nitrogen at a pressure of 150 to 300 bar.

8. The process according to claim 4, wherein there is employed argon at 50 to 300 bar.

9. The process according to claim 1 wherein the steam or saturated steam has a temperature of 100° C. to 200° C.

* * * * *